US007980226B2

(12) United States Patent
Hunt et al.

(10) Patent No.: US 7,980,226 B2
(45) Date of Patent: Jul. 19, 2011

(54) FUEL SYSTEM FOR A DIRECT INJECTION ENGINE

(75) Inventors: Frank Hunt, West Bloomfield, MI (US); Harsha Badarinarayan, Canton, MI (US); Takashi Yoshizawa, Novi, MI (US)

(73) Assignee: Hitachi, Ltd, Tokyo (JP)

( * ) Notice: Subject to any disclaimer, the term of this patent is extended or adjusted under 35 U.S.C. 154(b) by 285 days.

(21) Appl. No.: 12/414,151

(22) Filed: Mar. 30, 2009

(65) Prior Publication Data

US 2010/0242916 A1 Sep. 30, 2010

(51) Int. Cl.
*F02M 55/04* (2006.01)
*F02M 55/02* (2006.01)

(52) U.S. Cl. ..... 123/469; 123/456

(58) Field of Classification Search ..... 123/469, 123/468, 456, 447, 54.4, 198 D
See application file for complete search history.

(56) References Cited

U.S. PATENT DOCUMENTS

| | | | | |
|---|---|---|---|---|
| 6,009,856 | A | 1/2000 | Smith, III et al. | |
| 6,460,511 | B2 * | 10/2002 | Kato | 123/468 |
| 6,877,484 | B2 * | 4/2005 | Reiter | 123/468 |
| 6,901,964 | B2 | 6/2005 | Kippe et al. | |
| 7,293,550 | B2 | 11/2007 | Beardmore | |
| 7,334,571 | B1 | 2/2008 | Beardmore et al. | |
| 7,398,766 | B2 * | 7/2008 | Liskow | 123/469 |
| 7,406,946 | B1 | 8/2008 | Watanabe et al. | |
| 2002/0130205 | A1 * | 9/2002 | Luttrell et al. | 239/585.1 |
| 2010/0071664 | A1 * | 3/2010 | Hunt et al. | 123/456 |

* cited by examiner

*Primary Examiner* — Mahmoud Gimie
(74) *Attorney, Agent, or Firm* — Gifford, Krass, Sprinkle, Anderson & Citkowski, P.C.

(57) ABSTRACT

A fuel delivery system for a direct injection internal combustion engine which reduces mechanical stress on the fuel system components. The system includes a first and a second fuel rail mounted to the engine block for the internal combustion engine. A device is attached to the fuel rails which reduces movement of the fuel rails relative to the engine block and mechanical stress that would otherwise result from such movement.

17 Claims, 5 Drawing Sheets

FUEL SYSTEM FOR A DIRECT INJECTION ENGINE

BACKGROUND OF THE INVENTION

I. Field of the Invention

The present invention relates generally to direct injection internal combustion engines and, more particularly, to a fuel system for such engines which reduces the stress imposed on the fuel system components.

II. Description of Related Art

Direct injection internal combustion engines are becoming increasingly popular in the automotive industry due in large part to their high efficiency and fuel economy. In such a direct injection engine, at least one fuel injector is mounted in a bore formed in the engine block which is open directly to the internal combustion chamber. A high pressure fuel rail is coupled to the fuel injector which, when open under control of the engine control unit, injects fuel directly into the internal combustion engine.

Since the injectors of the direct injection engine are open directly to the internal combustion chamber, the fuel in the fuel rails must necessarily be maintained at a relatively high pressure. Typically, a cam driven piston pump is used to pressurize the fuel rail.

One disadvantage of direct injection internal combustion engines, however, is that the fuel system components move slightly relative to each other in response to the high pressure fuel injection pulses and pump pulses. This, in turn, imparts stress on the fuel system components which can result in cracking or other component failure.

SUMMARY OF THE PRESENT INVENTION

The present invention provides a device for reducing movement of the fuel rails in a direct injection fuel engine thereby reducing mechanical stress on those components.

In brief, the present invention provides several different approaches for reducing movement of the fuel rail in the fuel system. In one embodiment of the invention, a clamp extends across and is secured to both side by side fuel rails. By clamping the rails together, movement of the rails relative to the other fuel system components is reduced. Furthermore, the fuel rails may be either rigidly clamped together or may be resiliently clamped together with an elastomeric member.

In another form of the invention, a moving mass is attached to the fuel rails with a resilient member. Consequently, movement of the moving mass opposes any movement of the rails thus effectively canceling the movement of the rails during operation of the fuel system.

In still another embodiment of the invention, a flexible fluid conduit fluidly connects the fuel rails to the fuel injectors. This flexible fluid conduit thus reduces or altogether eliminates movement of the fuel rails caused by movement of the fuel injectors.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF PREFERRED EMBODIMENTS OF THE PRESENT INVENTION

Figure 1:
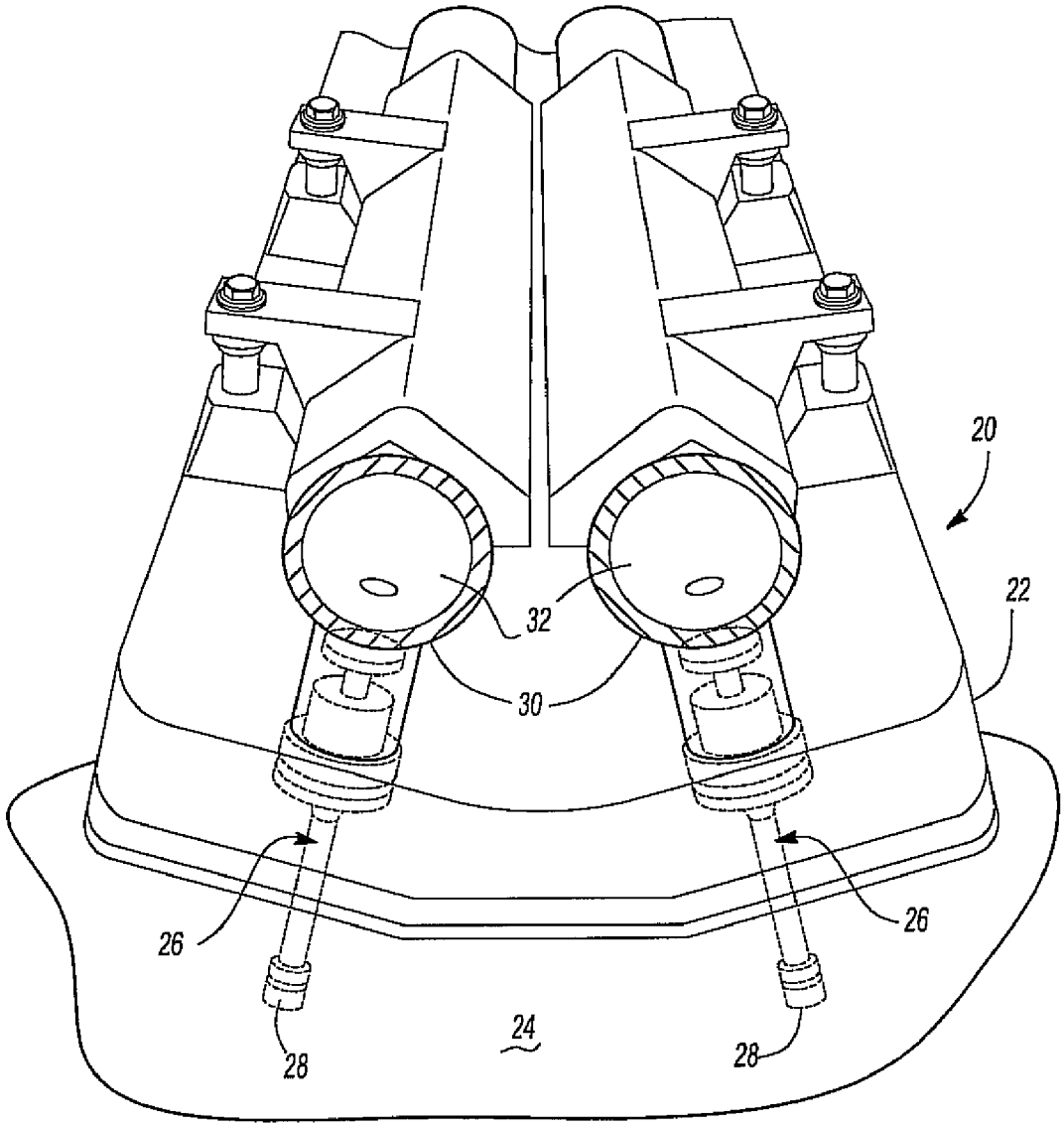
Fig-1 Prior Art
FIG. 1 is a prior art diagrammatic view of a direct injection internal combustion engine.

With reference first to FIG. 1, a portion of a prior art direct injection internal combustion engine 20 is shown diagrammatically. The engine 20 includes an engine block 22 having a plurality of engine combustion chambers 24 in which pistons (not shown) are reciprocally mounted.

At least one fuel injector 26 is associated with each combustion chamber 24. Each fuel injector 26 is positioned within a fuel injector bore 28 formed in the engine block 22 which is open to the combustion chambers 24. Each fuel injector 26, furthermore, is then fluidly coupled to a fuel rail 30 having an internal fuel chamber 32. A high pressure fuel pump (not shown) provides pressurized fuel to the fuel rail chambers 32 which, in turn, supply that pressurized fuel to the injectors 26. Furthermore, the fuel injectors illustrated in FIG. 1 are for a V engine in which two fuel rails 30 are positioned side by side each other.

Typically, the fuel injectors 26 are rigidly secured to their associated fuel rail 30. Upon each injection of fuel, the fuel injector 26 moves slightly away from the combustion chamber 24 which causes a like movement in its associated fuel rail 30. Such movement of the fuel rail 30 in turn imparts mechanical stress on the fuel system components.

Figure 2:
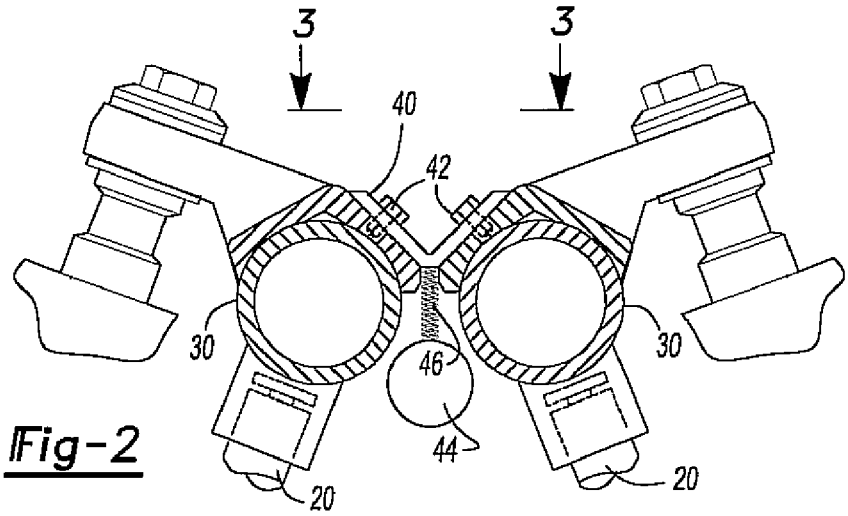
FIG. 2 is a diagrammatic end view illustrating a first preferred embodiment of the present invention.
Figure 3:
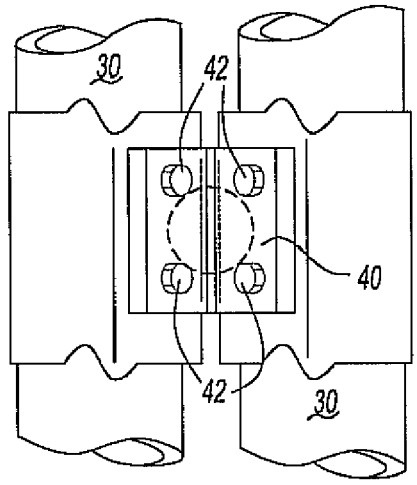
FIG. 3 is a view taken along line 3-3 in FIG. 2.

With reference now to FIGS. 2 and 3, in order to reduce the movement of the fuel rails 30 relative to the engine block, a V-shaped clamp 40 extends between and is attached to each fuel rail 30 by fasteners 42 FIG. 3). Any conventional fastener 42 may be used to secure the clamp 40 to the fuel rails 30. Alternatively, the clamp 40 may be fixedly secured to the fuel rails 30 by welding or the like.

A moving mass 44 is also secured to the clamp 40 by a resilient member or spring 46. The resilient member 46 allows the moving mass 44 to move relative to the clamp 40 and thus relative to the fuel rails 30.

In operation, as the fuel injectors impart movement to their associated fuel rails 30, the moving mass 44 moves thus effectively canceling any movement of the fuel rails 30. Furthermore, the clamp 40 itself alone reduces movement of the fuel rails 30 during operation of the internal combustion engine.

Although two fuel rails 30 are indicated in FIGS. 2 and 3, it will be understood, of course, that the moving mass 44 may also be used with a single fuel rail. In such a system, the moving mass 44 offsets or cancels movement of the fuel rail during operation of the engine.

Figure 4:
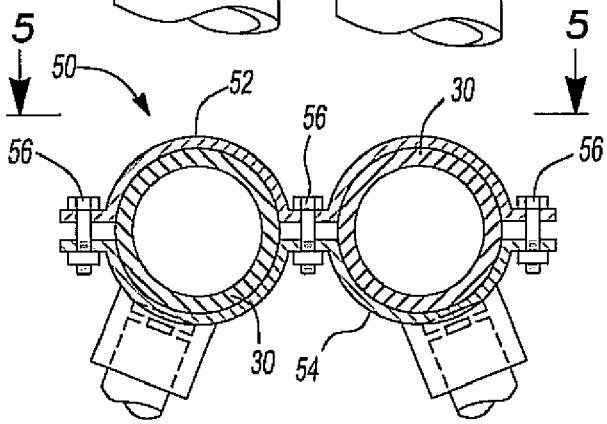
FIG. 4 is a view similar to FIG. 2, but illustrating a modification thereof.
Figure 5:
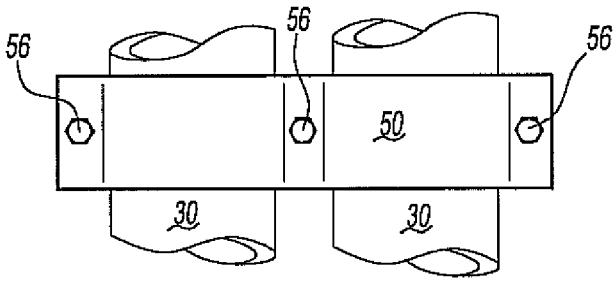
FIG. 5 is a view taken along line 5-5 in FIG. 4.

With reference now to FIGS. 4 and 5, a still further embodiment of the invention is illustrated in which a clamp 50 extends around both fuel rails 30 and secures the fuel rails 30 together against movement. Although the clamp 50 may take any form, as shown the clamp 50 includes a top half 52 and a bottom half 54 which, together, encircle the fuel rails 30. These clamp halves 52 and 54 are secured together by fasteners 56 which may be any conventional fastener, such as a bolt and nut.

In practice, the clamp 50, by rigidly securing the fuel rails 30 together, reduces movement of the fuel rails 30 and the resultant mechanical stress on the fuel system components from such movement.

Figure 6:
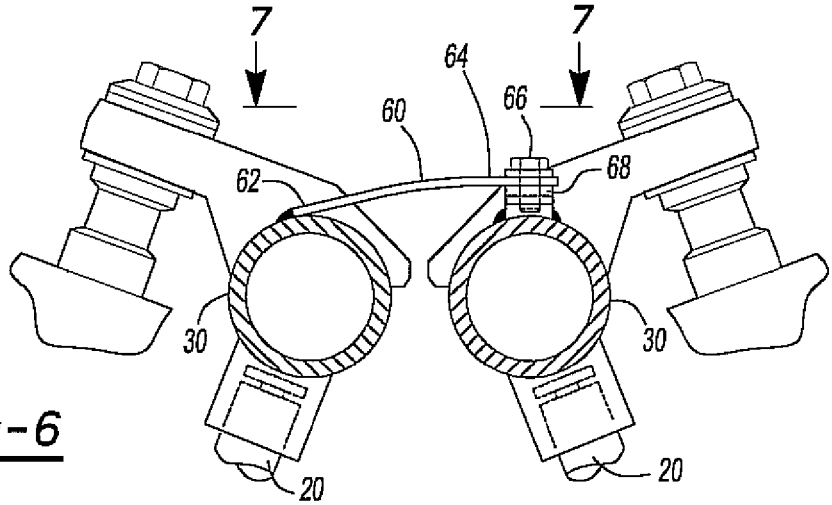
FIG. 6 is a view similar to FIG. 2, but illustrating a modification thereof.
Figure 7:
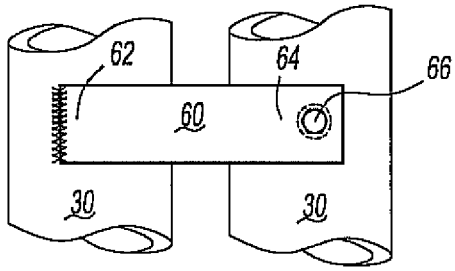
FIG. 7 is a view taken along line 7-7 in FIG. 6.

With reference now to FIGS. 6 and 7, a still further embodiment of the present invention is shown in which an elongated clamp 60 in the form of a strap has one end 62 rigidly secured to one fuel rail 30 in any conventional manner, such as by soldering. A second end 64 of the clamp 60 is then secured to the other fuel rail 30 by a fastener 66 which sandwiches an elastomeric resilient member 68 in between the fastener 66 and the fuel rail 30. In practice, the elastomeric dampener 68 dampens vibrations and movement of the fuel rails 30.

Figure 8:
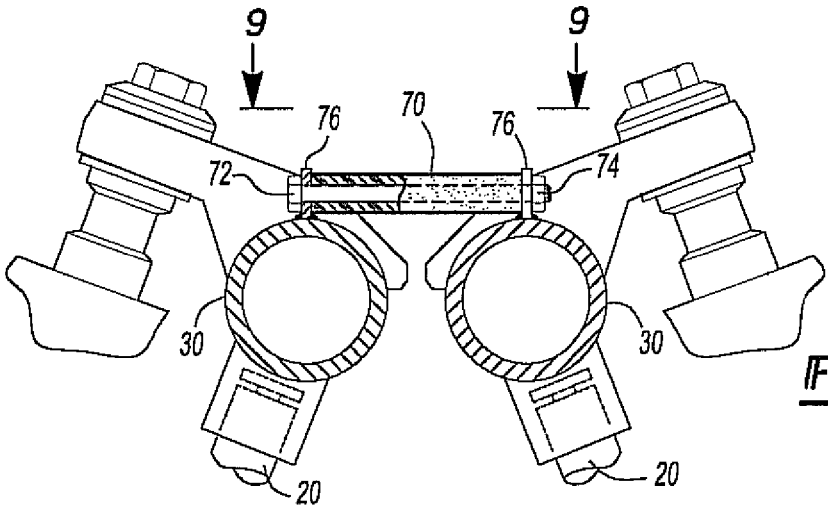
FIG. 8 is a view similar to FIG. 2, but illustrating a modification thereof.
Figure 9:
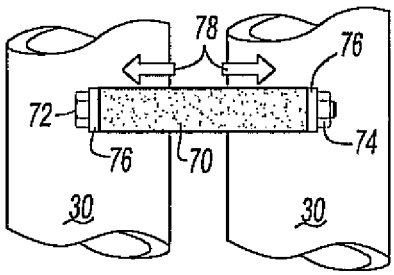
FIG. 9 is a view taken along line 9-9 in FIG. 8.

With reference now to FIGS. 8 and 9, a still further embodiment of the present invention is illustrated in which an elongated resilient dampener 70 extends between the two fuel rails 30. A fastener 72 secures one end of the dampener 70 to one fuel rail 30 while a second fastener 74 secures the other end of the dampener 70 to the other fuel rail 30. For example, the fastener 72 may comprise a bolt extending through the dampener 70 while the second fastener 74 is a nut that threadably engages the fastener 72. The fastener 72 also extends through a bolt stop 76 mounted to each fuel rail 30.

In practice, the dampener 70 dampens vibrations of the fuel rails 30 in a lateral direction as indicated by arrows 78 in FIG. 9. By dampening the relative movement of the fuel rails 30 relative to each other, the dampener 70 effectively reduces movement of the fuel rail and likewise reduces component stress resulting from that movement.

Figure 10:
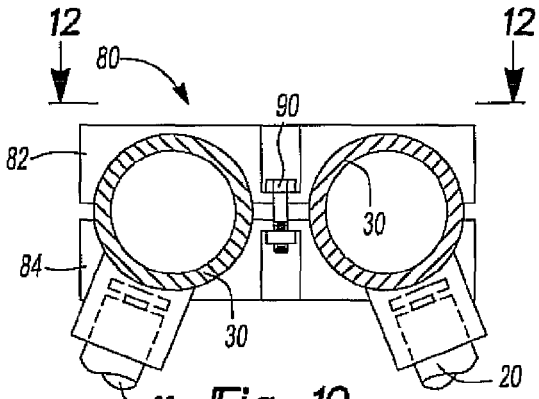
FIG. 10 is a view similar to FIG. 2, but illustrating a modification thereof.
Figure 11:
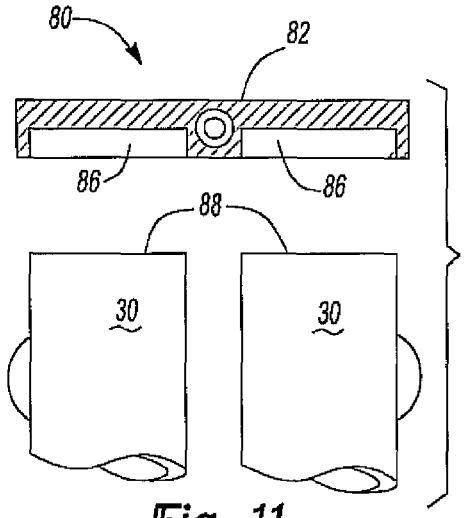
FIG. 11 is an exploded fragmentary top view of the fuel rails of FIG. 10.
Figure 12:
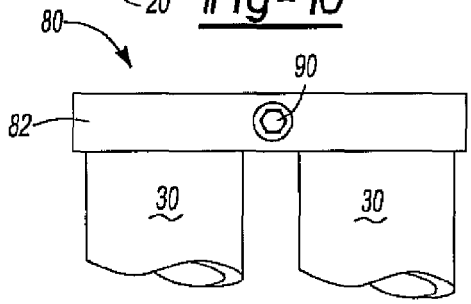
FIG. 12 is a view taken substantially along line 12-12 in FIG. 10.

With reference now to FIGS. 10-12, a still further embodiment of the present invention is shown in which a clamp 80 having two clamp sections 82 and 84 is provided to minimize movement of the fuel rails 30. Each clamp section 82 and 84 includes a recess 86 which corresponds in shape to a portion of the ends 88 of the fuel rails 30.

Consequently, as best shown in FIGS. 10 and 12, with the clamp sections 82 and 84 positioned around the ends 88 of the fuel rails 30, a fastener 90 secures the clamp sections 82 and 84 together while simultaneously compressing the clamp sections 82 and 84 around the ends 88 of the fuel rails 30. In doing so, the fuel rails 30 are rigidly secured together against movement thus reducing mechanical stress on the fuel system components.

Figure 13:
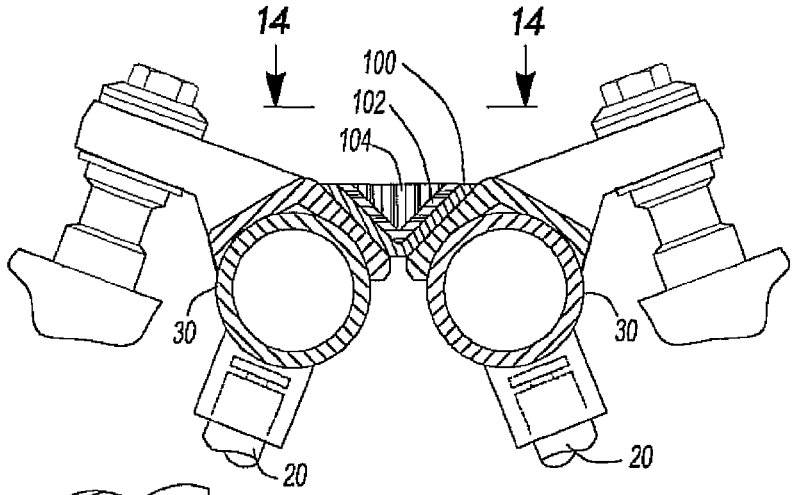
FIG. 13 is a view similar to FIG. 2, but illustrating a modification thereof.
Figure 14:
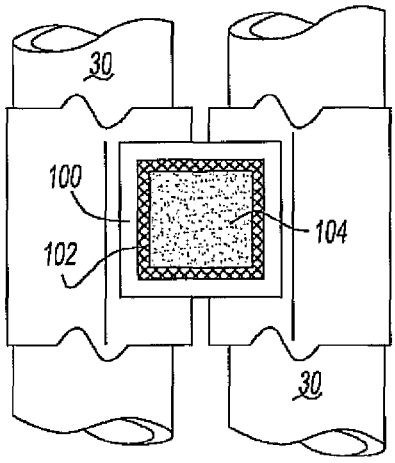
FIG. 14 is a view taken along line 14-14 in FIG. 13.

With reference now to FIGS. 13 and 14, a still her embodiment of the present invention is shown in which a generally V-shaped clamp 100 extends between and is secured to both fuel rails 30. Any conventional means, such as fasteners, solder or the like, may be used to secure the clamp 100 rigidly to the fuel rails 30.

A resilient member 102, preferably constructed of an elastomeric material, is disposed across the top of the clamp 100. A moving mass 104 is then positioned within the resilient member 102 so that the resilient member 102 is sandwiched in between the moving mass 104 and the clamp 100.

In operation, the resilient member 102 allows the moving mass 104 to move slightly relative to the fuel rails 30. The moving mass 104, by moving, dampens the movement of the rails 30 and reduces component stress.

Figure 15:
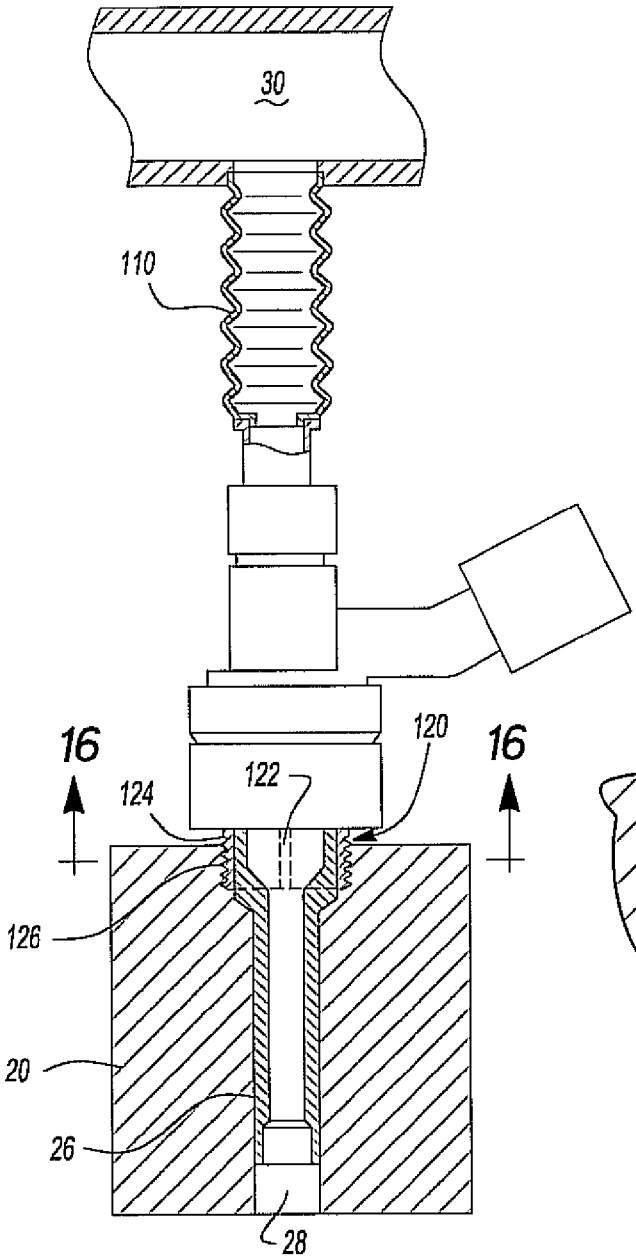
FIG. 15 is a side view illustrating a further embodiment of the present invention.
Figure 16:
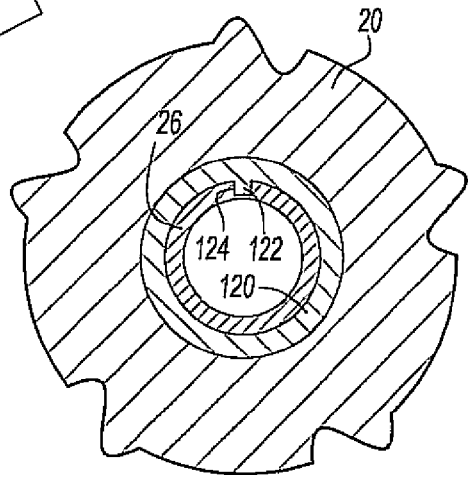
FIG. 16 is a view taken along line 16-16 in FIG. 15.

With reference now to FIGS. 15 and 16, a still further embodiment of the present invention is shown in which the fuel injector 26 is fluidly connected to its associated fuel rail 30 by a flexible fluid conduit 110. The fluid conduit 110 may be in the shape of a flexible bellows although other shapes may alternatively be used. In operation, movement of the fuel injector 26 in response to a fuel injection by the injector 26 merely causes the fluid conduit 110 to flex, thus isolating any vibration of the fuel injector 26 from the fuel rail 30. In doing so, movement of the fuel rail 30 is greatly reduced, if not altogether eliminated, thus reducing mechanical stress caused by movement of the fuel rail 30.

Still referring to FIGS. 15 and 16, since the fuel injector 26 is no longer rigidly connected to the fuel rail 30, it is preferable to secure the fuel injector 26 to the engine block 20 against movement. Although various means may be used to secure the fuel injector 26 to the engine block 20, as illustrated in FIG. 15, a locator 120 is externally threaded and includes a radially inwardly projecting tab 122. The locator 120 is preferably made of a non-metallic material to eliminate metal-to-metal contact between the injector 26 and the engine block 20 to dampen noise. With the fuel injector 26 positioned within the bore 28 of the engine block, the tab 122 of the locator 120 registers with a notch 124 in the fuel injector 26. The cooperation between the locator tab 122 and the notch 124 prevents rotational or twisting movement of the fuel injector 26 relative to the locator 120.

In order to secure the locator 120 to the engine block, the injector bore 28 includes an internally threaded portion 126 at its outer end. Consequently, by threadably securing the locator to the engine block 20, the locator 120 simply, but effectively, locks the fuel injector 26 against axial movement relative to the engine block.

Alternatively, the fuel injector 26 can be made of a non-metallic material with the threads to engage the thread portion 126 on the engine block formed integrally on the fuel injector 26.

From the foregoing, it can be seen that the present invention provides several different devices for reducing, or altogether eliminating, movement of the fuel rail relative to the engine block. Stress on the fuel system components resulting from movement of the fuel rail relative to the engine block during operation of the internal combustion engine is substantially reduced.

Having described our invention, however, many modifications thereto will become apparent to those skilled in the art to which it pertains without deviation from the spirit of the invention as defined by the scope of the appended claims.

We claim:

1. In a direct injection internal combustion engine having an engine block and at least one fuel rail, a system to reduce movement of the fuel rail relative to the engine comprising:

a dynamic weight, a resilient member which attaches said weight to the fuel rail so that said dynamic weight is movable relative to the fuel rail and is not directly attached to the engine block.

2. The system as defined in claim 1 wherein said resilient member comprises a spring.

3. The apparatus as defined in claim 1 wherein the engine includes a second fuel rail spaced apart from said first fuel rail, and wherein said resilient member attaches said weight to both fuel rails.

4. Apparatus to reduce mechanical stress in a fuel delivery system for a direct injection internal combustion engine having an engine block comprising:

a first and a second fuel rail mounted to the engine block, a device extending between said first and second fuel rails which reduces movement of said fuel rails relative to the engine block.

5. The apparatus as defined in claim 4 wherein said device comprises a clamp disposed around at least a portion of both fuel rails.

6. The apparatus as defined in claim 5 wherein said clamp comprises a strap having one end secured to said first fuel rail and a second end attached to said second fuel rail.

7. The apparatus as defined in claim 6 and comprising an elastomeric coupler between said second end of said strap and said second fuel rail.

8. The apparatus as defined in claim 4 wherein said device comprises an elastomeric member having a first end attached to said first fuel rail and a second end attached to said second fuel rail.

9. The apparatus as defined in claim 8 wherein said elastomeric member is elongated and extends transversely between said first and second fuel rails.

10. The apparatus as defined in claim 4 wherein each fuel rail is elongated, said fuel rails being positioned side by side each other, and wherein said device comprises a rigid plate secured across one end of both fuel rails.

11. The apparatus as defined in claim 10 and comprising a second rigid plate secured across the other ends of said fuel rails.

12. The apparatus as defined in claim 4 and comprising a clamp extending between and rigidly secured to both fuel rails, a moving mass and a resilient member sandwiched between said moving mass and said clamp.

13. A fuel system for a direct injection internal combustion engine having an engine block, said fuel system comprising:

a fuel rail defining an interior fuel chamber, a fuel injector positioned in a bore in the engine block, a flexible fluid conduit which fluidly connects said fuel rail fuel chamber to said fuel injector, a fastener which secures said fuel injector to the engine block, wherein said fastener includes a locator pin which nests in a locator slot in said fuel injector.

14. The system as defined in claim 13 wherein said fluid conduit comprises a bellows.

15. The system as defined in claim 13 wherein said fastener includes an externally threaded portion which threadably engages an internally threaded portion of said bore.

16. The system as defined in claim 13 wherein said fuel injector is made of a non-metallic material and includes external threads which threadably engage a threaded hole in the engine block.

17. The system as defined in claim 13 wherein said fastener is made of a non-metallic material.

* * * * *